US008757434B2

(12) United States Patent
Roekens et al.

(10) Patent No.: US 8,757,434 B2
(45) Date of Patent: Jun. 24, 2014

(54) MERCHANDISER

(75) Inventors: Jurgen Roekens, Kampenhout (BE); Bart Carpentier, Zoersel (BE); David Pas, Antwerp (BE); Michael J. Kline, Marietta, GA (US)

(73) Assignee: The Coca-Cola Company, Atlanta, GA (US)

( * ) Notice: Subject to any disclaimer, the term of this patent is extended or adjusted under 35 U.S.C. 154(b) by 381 days.

(21) Appl. No.: 12/828,345

(22) Filed: Jul. 1, 2010

(65) Prior Publication Data

US 2012/0000744 A1 Jan. 5, 2012

(51) Int. Cl.
*A47F 1/00* (2006.01)

(52) U.S. Cl.
USPC ..... 221/97; 221/66; 221/150 HC; 221/82; 221/150 R; 221/1; 221/102; 221/151; 221/93; 194/4; 194/4 C; 62/246

(58) Field of Classification Search
CPC ..... G07F 7/06
USPC ..... 221/66, 150 HC, 82, 150 R, 1, 97, 102, 221/151, 93; 194/4, 4 C; 62/246
See application file for complete search history.

(56) References Cited

U.S. PATENT DOCUMENTS

| | | | | |
|---|---|---|---|---|
| 882,858 | A | 3/1908 | Alexander et al. | |
| 2,254,208 | A | 9/1941 | Buford | |
| 2,260,643 | A * | 10/1941 | Rosan | 221/18 |
| 2,266,025 | A | 12/1941 | Grau | |
| 2,371,845 | A | 3/1945 | Robison | |
| 2,408,444 | A | 10/1946 | Payne | |
| 2,671,001 | A | 3/1954 | Ossanna, Jr. | |
| 3,055,548 | A * | 9/1962 | Allegri | 221/281 |
| 3,294,282 | A | 12/1966 | Brown | |
| 4,252,250 | A | 2/1981 | Toth | |
| 4,325,227 | A | 4/1982 | Ibrahim | |
| 4,361,012 | A | 11/1982 | Ibrahim | |
| 4,411,351 | A * | 10/1983 | Lowder et al. | 194/212 |
| 4,478,047 | A | 10/1984 | Ibrahim | |
| 4,615,169 | A | 10/1986 | Wurmli | |
| 4,687,119 | A | 8/1987 | Juillet | |
| 4,823,982 | A | 4/1989 | Aten et al. | |
| 4,919,250 | A * | 4/1990 | Olson et al. | 194/248 |
| 5,048,719 | A | 9/1991 | Empl et al. | |
| 5,201,191 | A | 4/1993 | Bustos | |
| 5,247,798 | A * | 9/1993 | Collard, Jr. | 62/3.62 |
| 6,073,460 | A | 6/2000 | Credle, Jr. et al. | |
| 6,170,230 | B1 | 1/2001 | Chudy et al. | |
| 6,173,582 | B1 * | 1/2001 | Hixson | 62/457.4 |

(Continued)

FOREIGN PATENT DOCUMENTS

| | | |
|---|---|---|
| FR | 2626757 A1 | 1/1989 |
| FR | 2641887 A1 | 7/1990 |

(Continued)

*Primary Examiner* — Gene O. Crawford
*Assistant Examiner* — Rakesh Kumar
(74) *Attorney, Agent, or Firm* — Sutherland Asbill & Brennan LLP

(57) ABSTRACT

The present application provides a merchandiser. The merchandiser may include an ambient compartment with at least one ambient product therein, a temperature controlled compartment with at least one temperature controlled product therein, and a vending module in communication with the temperature controlled compartment such that the vending module dispenses a temperature controlled product in response to an ambient product being placed in the vending module.

22 Claims, 6 Drawing Sheets

(56) References Cited

U.S. PATENT DOCUMENTS

| | | | | |
|---|---|---|---|---|
| 6,247,610 | B1 | 6/2001 | Ziesel et al. | |
| 6,286,715 | B1 | 9/2001 | Ziesel et al. | |
| 6,499,627 | B2 | 12/2002 | Arai | |
| 6,625,952 | B1 | 9/2003 | Chudy et al. | |
| 6,801,836 | B2 | 10/2004 | Schanin | |
| 6,808,082 | B2 | 10/2004 | Ohkubo | |
| 7,228,989 | B2 | 6/2007 | Bhatti et al. | |
| 7,559,482 | B2 * | 7/2009 | Coveley | 235/492 |
| 2003/0201275 | A1 | 10/2003 | Tamura | |
| 2004/0026446 | A1 * | 2/2004 | Mori et al. | 221/232 |
| 2004/0140317 | A1 | 7/2004 | Forte | |
| 2006/0026446 | A1 * | 2/2006 | Schlereth | 713/300 |
| 2006/0028392 | A1 | 2/2006 | Coveley | |
| 2006/0261080 | A1 | 11/2006 | Matsumoto et al. | |
| 2008/0011771 | A1 | 1/2008 | Roekens et al. | |
| 2009/0029016 | A1 | 1/2009 | Pfister et al. | |
| 2011/0186591 | A1 * | 8/2011 | Pfister | 221/97 |
| 2012/0000744 | A1 | 1/2012 | Roekens et al. | |
| 2012/0000927 | A1 | 1/2012 | Carpentier et al. | |

FOREIGN PATENT DOCUMENTS

| | | | |
|---|---|---|---|
| WO | 00/32477 | A1 | 6/2000 |
| WO | 2004/017266 | A2 | 2/2004 |
| WO | 2004/017268 | A2 | 2/2004 |
| WO | WO 2004017268 | A2 * | 2/2004 |
| WO | 2008057914 | A2 | 5/2008 |
| WO | 2010/008611 | A2 | 1/2010 |
| WO | WO 2010008611 | A2 * | 1/2010 |
| WO | 2010149402 | A1 | 12/2010 |
| WO | 2012/003206 | A2 | 1/2012 |

* cited by examiner

MERCHANDISER

TECHNICAL FIELD

The present application relates generally to merchandisers such as coolers and other types of product dispensers and more particularly relates to a merchandiser with features of an open front cooler and with the increased energy efficiency of a glass door merchandiser.

BACKGROUND OF THE INVENTION

Generally described, an open front cooler includes a refrigerated open enclosure with a number of products therein within the reach of a consumer. Because of this quick and easy accessibility and proximity to the chilled products therein, open front coolers often spur impulse purchases by consumers, who prefer chilled products to those at ambient temperatures. As a result, open front coolers generally provide an increased sales volume over conventional glass door merchandisers and the like of the same size and/or in similar locations and/or with products stored at ambient temperatures on shelves.

One drawback with conventional open front coolers, however, is that the cooler consumes several times more energy than a glass door merchandiser of the same size due to the lack of a door or other type of insulated front space. The increased sales revenue generally provided by an open front cooler thus may not cover or justify the increased energy cost.

There is thus a desire therefore for an improved open front cooler or other type of merchandiser that promotes impulse purchases and easy accessibility like an open front cooler but with the reduced energy costs of a glass door merchandiser and the like.

SUMMARY OF THE INVENTION

The present application thus provides a merchandiser as may be described herein. The merchandiser may include an ambient compartment with at least one ambient product therein, a temperature controlled compartment with at least one temperature controlled product therein, and a vending module in communication with the temperature controlled compartment such that the vending module dispenses a temperature controlled product in response to an ambient product being placed in the vending module.

The ambient compartment may include a number of ambient compartment shelves while the temperature controlled compartment may include one or more temperature controlled shelves. The vending module may include an identification module to identify each ambient product and wherein the vending module vends a temperature controlled product corresponding to the ambient product identified by the identification module.

The vending module may include an internal transport system in communication with the identification module and a vending chute. The temperature controlled compartment may include one or more temperature controlled shelves with a number of columns thereon and the vending module may include a number of column conveyor belts positioned about the number of columns. The vending module may include one or more transverse conveyor belts in communication with the number of column conveyor belts. The temperature controlled compartment may include a number of vertical chutes and the vending module may include a top conveyor belt positioned about the number of vertical chutes.

The temperature controlled compartment may include a heating/cooling module. The ambient compartment may be separate from the temperature controlled compartment. The ambient compartment may include an open compartment and/or a vending compartment.

The ambient compartment may include a closed compartment with a door and a transparent portion permitting viewing of the ambient products inside the compartment. The merchandiser also may include a payment module such that the door is accessible only upon a user completing a payment operation using the payment module.

The present application further provides a method of dispensing a number of temperature controlled products. The method may include the steps of providing a number of ambient products in and ambient compartment, providing a number of temperature controlled products in a temperature controlled compartment, identifying a selected one of the ambient products, maneuvering the selected one of the ambient products to a temperature controlled compartment, and dispensing one of the temperature controlled products that corresponds to the selected one of the ambient products. The step of providing the ambient products may include providing a number of ambient products in an open compartment or a vending compartment. The temperature controlled product may be a cooled product or a heated product.

The present application further provides a merchandiser. The merchandiser may include an open compartment with a number of ambient products positioned on a number of ambient product shelves, a temperature controlled compartment with a number of temperature controlled products positioned on one or more temperature controlled shelves, an identification module, and a vending module in communication with the temperature controlled compartment. The identification module may identify one of the ambient products and the vending module may vend one of the temperature controlled products that corresponds to the ambient product as determined by the identification module.

The vending module may include an internal transport system in communication with the identification module and a vending chute. The temperature controlled compartment may include a heating/cooling module. The open compartment may be separate from the temperature controlled compartment.

These and other features and improvements of the present application will become apparent to one of ordinary skill in the art upon review of the following detailed description when taken in conjunction with the several drawings and the appended claims.

DETAILED DESCRIPTION

Figure 1:
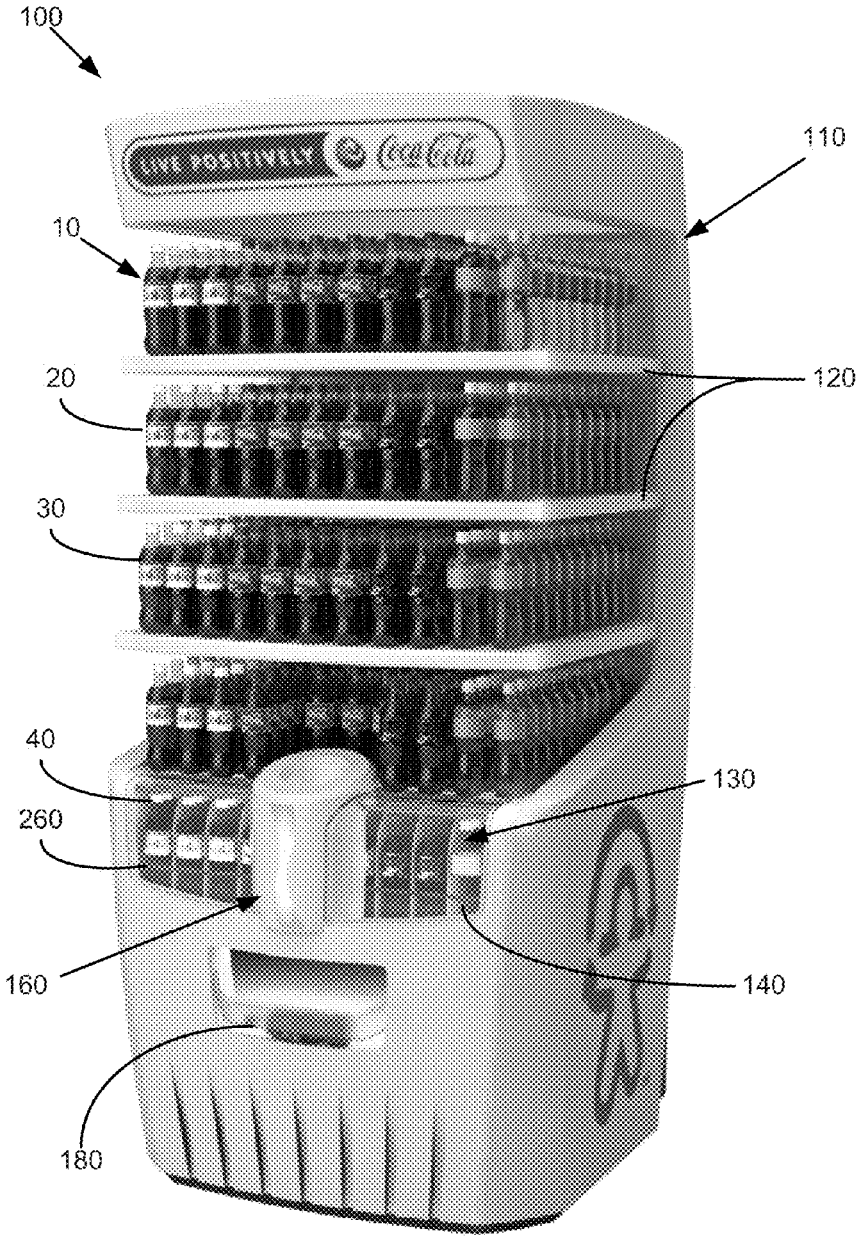
FIG. 1 is a perspective view of an example of a merchandiser as is described herein.

The present application concerns the offer for sale or other use of, any number of products 10. Although the products 10 are shown, by way of example only, in the form of bottles 20, is understood that the products 10 may include any type or size of container including, but not limited to, bottles, cans, pouches, boxes, wrapped items, and/or any type of rigid or flexible packaging. The products 10 may include beverages, food items, non-food items, consumer products, and/or any type of product 10 that may be positioned on a shelf and/or that may be vended. The scope of this application is in no way limited by the nature of the products 10 intended to be used herein. Similarly, while one use herein is for a chilled product 10, it will be understood that the products 10 herein may be at ambient, refrigerated, frozen, heated or at any desired temperature or state.

As will be described in more detail below, the products 10 herein may take the form of ambient products 30 and temperature controlled products 40. The ambient products 30 and the temperature controlled products 40 may or may not be the same product 10. Other product variations may be used herein.

Figure 2:
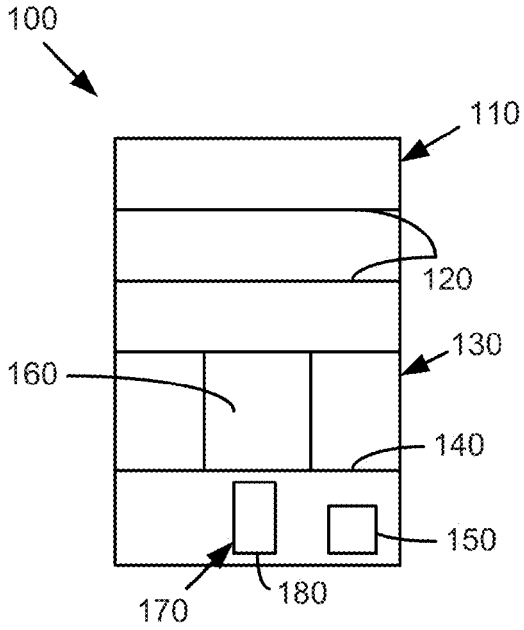
FIG. 2 is schematic view of the merchandiser of FIG. 1.

FIGS. 1 and 2 show a merchandiser 100 as may be described herein. The merchandiser 100 may include one or more open or ambient compartments 110. Each ambient compartment 110 may include a number of open or ambient compartment shelves 120. Any number of ambient compartment shelves 120 may be used. Likewise, the ambient compartment shelves 120 may have any desired shape or size. Any number of the products 10 may be placed on the ambient compartment shelves 120. Although flat shelves are shown herein, the ambient compartment shelves 120 may be any structure that may support the products 10 such as angled shelves, gravity feed shelves, neck tracker tubes, product chutes, and the like. Likewise, vertical columns and conventional vending columns also may be used. At least the front of the ambient compartment 110 may allow unimpeded access to the products 10 on the ambient compartment shelves 120.

The ambient compartment 110 described herein generally at an ambient temperature and as such is not temperature controlled. Likewise, the products 10 therein may be at an ambient temperature. Part or the entire ambient compartment 110, however, could be heated, cooled, or otherwise temperature controlled as desired at least temporarily.

The merchandiser 100 also may include a temperature controlled compartment 130. The temperature controlled compartment 130 may be enclosed and/or insulated. The temperature controlled compartment 130 may have any number of temperature controlled shelves 140. The temperature controlled shelves 140 may have any desired shape, size, or orientation. Although only one temperature controlled shelf 140 is shown, any number of shelves 140 may be used. Although flat shelves are shown herein, the temperature controlled shelves 140 may be any structure that may support the products 10 such as angled shelves, gravity feed shelves, neck tracker tubes, product chutes, and the like. Likewise, vertical columns and conventional vending columns also may be used. Although the temperature controlled compartment 130 is shown in FIGS. 1 and 2 as integral with the merchandiser 100, it is to be understood that the temperature controlled compartment 130 may operate as a stand-alone unit, allowing ambient products 10 such as on traditional store shelves or containers to be used in combination with the temperature controlled compartment 130 as described herein.

The number of ambient compartment shelves 120 is generally greater than the number of temperature controlled shelves 140, but not necessarily so. The temperature controlled compartment 130 may be at any desired temperature from freezing, chilled, ambient, warm, or hot. The temperature controlled compartment 130 may be in communication with a conventional heating/cooling module 150 and the like. Multiple temperature controlled compartments 130 with multiple temperatures also may be used herein. Although the temperature controlled compartment 130 is shown as positioned beneath the ambient compartment 110, the temperature controlled compartment 130 may be positioned on top, on the side, or, as explained below, apart from the ambient compartment 110.

The temperature controlled compartment 130 and/or the ambient compartment 110 may include a scanner or other type of identification module 160. The scanner module 160 may include a barcode scanner, an RFID tag reader, photoelectric cells, and/or any type of device that may read indicia on the product 10, identify the shape of the product 10, or otherwise identify the product 10. Alternatively, the identity of the product 10 may be entered or otherwise indicated by a consumer such as by pressing a product selection button and the like. Other types of selection means may be used herein. Although the scanner module 160 is shown as being positioned adjacent to the temperature controlled compartment 130, the scanner module 160 may be positioned in any convenient location. The scanner module 160 also may reject a product 10 that is not intended to be used with the merchandiser 100 as a whole.

The merchandiser 100 also may include a vending module 170. The vending module 170 may include a vending port 180. Although the vending port 180 is shown as being positioned adjacent to the temperature controlled compartment 130 and the scanner module 160, the vending module 170 may be positioned in any convenient location.

The vending module 170 may include an internal transport system 190. The internal transport system 190 may transport the products 10 from the scanner module 160 or other location to a location within the temperature controlled compartment 130 or otherwise. The internal transport system 190 also may transport the products 10 to the vending port 180 or otherwise as desired. Any number. of internal transport system configurations may be used herein.

Figure 3:
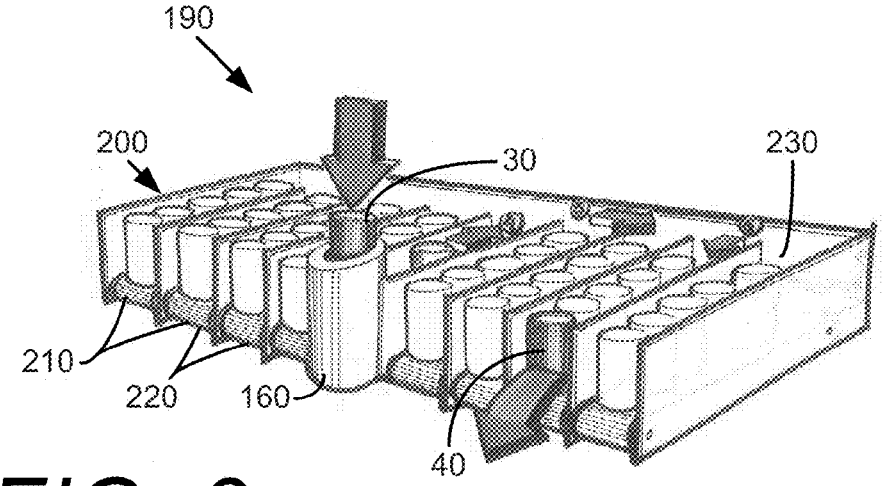
FIG. 3 is a perspective view of an internal transport system as may be used with the merchandiser of FIG. 1.

FIG. 3 shows an embodiment of the internal transport system 190 as a conveyor belt system 200. The temperature controlled shelves 140 may be divided into a number of columns 210 with the products 10 thereon. Each or some of the columns 210 may have a column conveyor belt 220 positioned thereabout or a similar type of product drive means. The column conveyor belts 220 also may be in communication with a transverse conveyor belt 230 or a similar type of product drive means. In this example, the transverse conveyor belt 230 may be positioned at the rear of the temperature controlled compartment 130. Other vending configurations may be used herein.

In use, one of the column conveyor belts 220 may deliver a selected ambient product 30 from the scanner module 160 and deliver it to the transverse belt 230 or otherwise. The transverse belt 230 then may deliver the product 30 to one of the columns 210 so as to be temperature controlled. Likewise, the column belt 220 may dispense the corresponding temperature controlled product 40 to be vended to the vending port 180 or otherwise via gravity or otherwise. Other vending procedures may be used herein.

Figure 4:
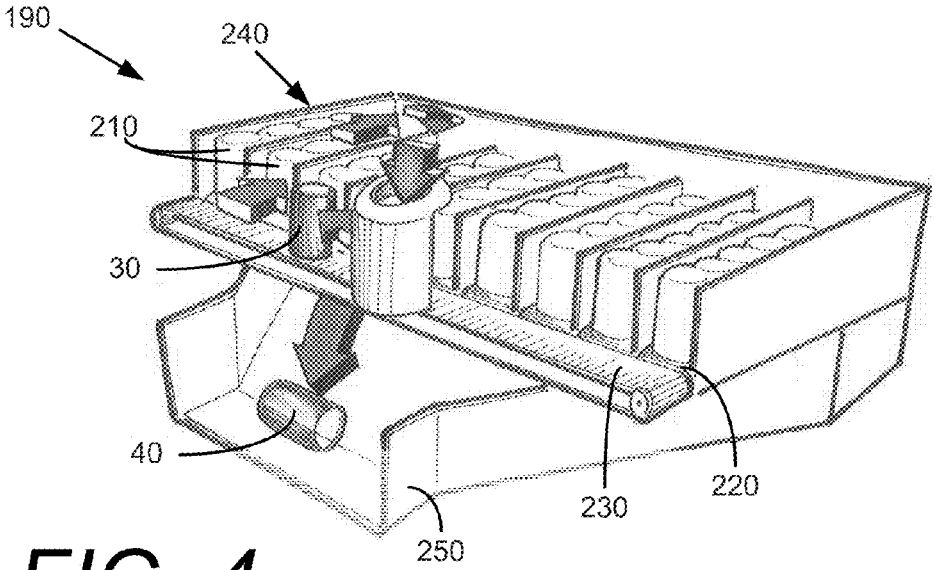
FIG. 4 is a perspective view of an alternative embodiment of the internal transport system as may be used with the merchandiser of FIG. 1.

FIG. 4 shows a further embodiment of the internal transport system as a conveyor belt and chute system 240. The conveyor belt and chute system 240 also may include a number of columns 210 with column conveyor belts 220 thereon as well as a transverse conveyor belt 230 or a similar type of drive means. In this case, the transverse conveyor belt 230 may be positioned about the scanner module 160. Other positions may be used herein. A chute 250 may be positioned beneath the shelf 140 and in communication with the vending port 180. Other vending configurations may be used herein.

In use, the transverse conveyor belt 230 may remove the selected ambient product 30 from the scanner module 160 and deliver it to the appropriate column 210 to be temperature controlled. The column conveyor belt 220 then may position the ambient product 30 onto the column 210 while also dispensing the corresponding temperature controlled product 40 into the chute 250 via gravity or otherwise. Alternatively, a positioning bar 260 may push the selected ambient product 30 into the appropriate column 210. Other vending procedures may be used herein.

Figure 5:
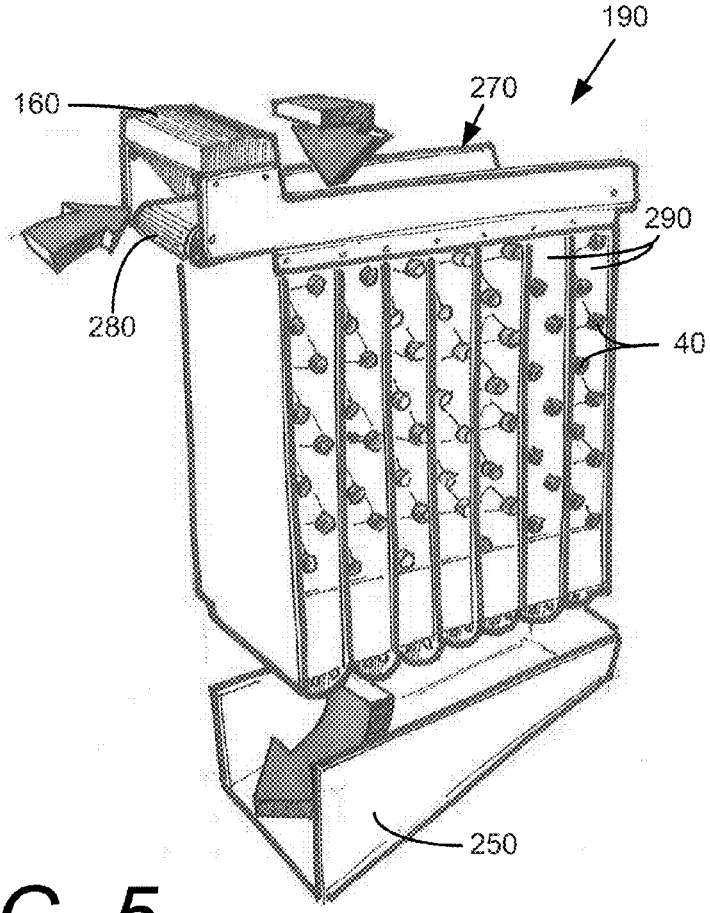
FIG. 5 is a perspective view of a further alternative embodiment of the internal transport system as, may be used with the merchandiser of FIG. 1.

FIG. 5 shows a further embodiment of the internal transport system as a vertical product system 270. The vertical product system 270 may include the scanner module 160 positioned on top of the temperature controlled compartment 130. The vertical product system 270 may include a top conveyor 280 while the temperature controlled compartment 130 may include a number of vertical chutes 290 in communication therewith as the temperature controlled shelves 140. Other vending configurations may be used herein.

In use, a selected ambient product 30 may be read by the scanner module 160 and then travel along the top conveyor 280 into one of the chutes 290. Likewise, the corresponding temperature controlled product 40 may drop out of the chutes 290 and into the vending port 180 under gravity or otherwise. Alternatively, a number of the angled shelves 140 may be used such that the top conveyor 280 may deliver the ambient product 30 to the back of one of the shelves 140 and the temperature controlled product 40 may exit from the front of one of the shelves 140. A vertical transport system also may be used herein. Other vending procedures may be used herein.

Figure 6:
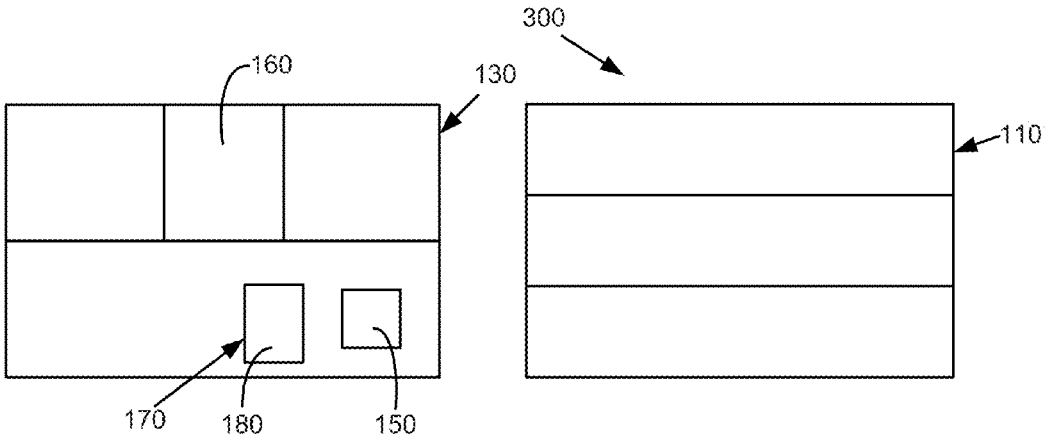
FIG. 6 is a schematic view of an alternative embodiment of a merchandiser as may be described herein.
Figure 7:
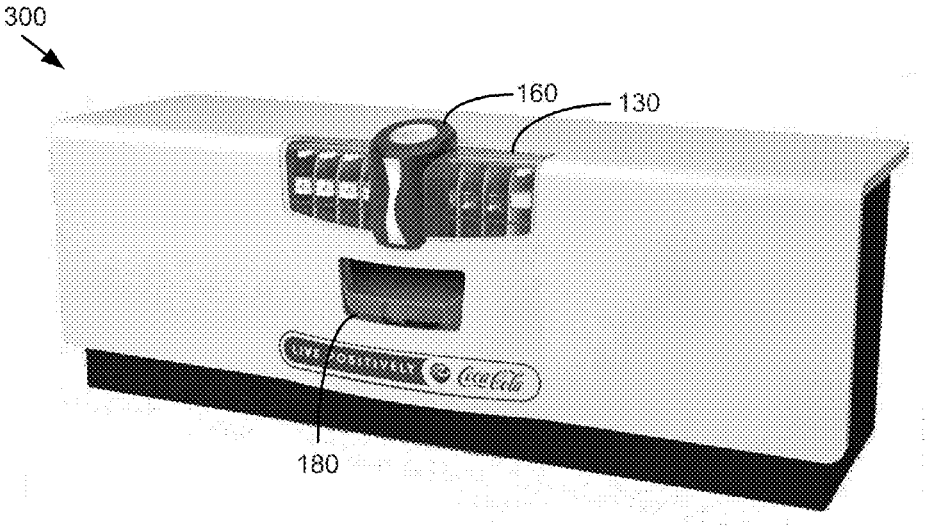
FIG. 7 is a perspective view of an example of the merchandiser of FIG. 6.

FIGS. 6 and 7 show a further embodiment of a merchandiser 300. In this embodiment, the merchandise 300 may be modular with the ambient compartment 110 separate from the temperature controlled compartment 130. Although the scanner module 160 is shown as being part of the temperature controlled compartment 130, the scanner module 160 also may be positioned at any convenient location. Likewise, the heating/cooling module 150 is shown as being positioned within the temperature control compartment 130 but also could be positioned elsewhere as may be desired. Moreover, only the temperature controlled compartment 130 may be used. Other configurations may be used herein.

Figure 8:
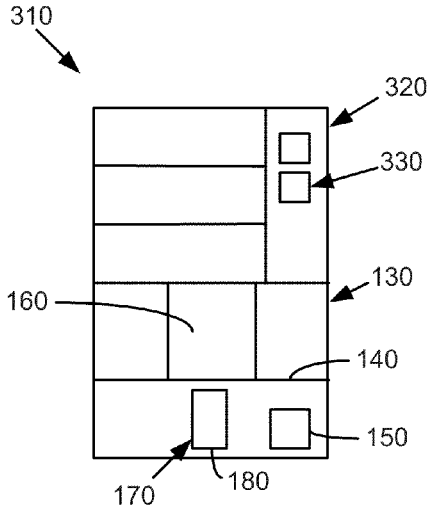
FIG. 8 is a schematic view of a further alternative embodiment of a merchandiser as may be described herein.
Figure 9:
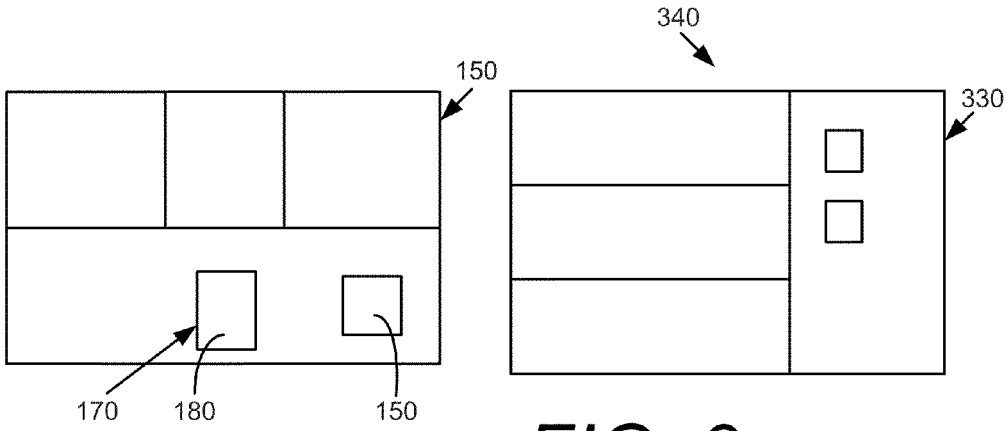
FIG. 9 is a schematic view of a further alternative embodiment of a merchandiser as may be described herein.

FIG. 8 shows a further embodiment of a merchandiser 310. The merchandiser 310 may include a vending compartment 320 instead of the ambient compartment 110. The vending compartment 320 may include conventional vending controls 330 such as selection panels and payment devices. A consumer may make a product selection at the vending compartment 320. The vending compartment 320 may deliver the ambient product 30 to the temperature controlled compartment 130 and/or the scanner module 160. The corresponding temperature controlled product 40 then may be vended as above. The vending compartment 320 may be at ambient or any desired temperature. As is shown in FIG. 9, a merchandiser 340 also may be modular with the vending compartment 320 separate from the temperature controlled compartment 130. Other configurations may be used herein.

In an alternative embodiment, the merchandiser 310 may include an ambient glass front compartment that resembles a glass front cooler, but operates at ambient temperature. The glass front portion of the merchandiser 310 may sit integrally with or merely proximate to the temperature controlled compartment 130, and may be accessed in response to a payment operation that allows the door to be opened via a payment module in response to completing a valid transaction.

Figure 10:
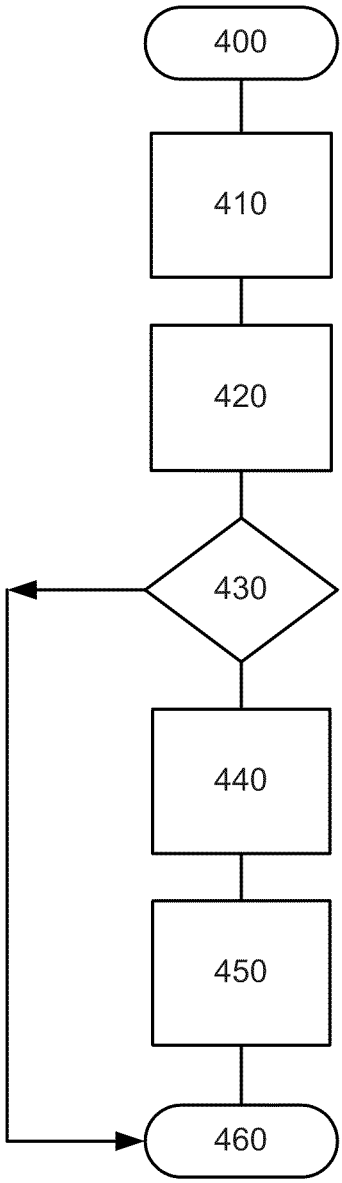
FIG. 10 is a flowchart showing a number of steps in the dispensing of a product in the merchandiser described herein.

FIG. 10 shows a flowchart of several of the process steps that may be used herein in providing the product 10 to a consumer. The process starts at step 400 in which the consumer approaches the merchandiser 100. At step 410, the consumer may remove one of the products 10 from one of the ambient compartment shelves 120 of the ambient compartment 110, i.e., the selected ambient product 30. At step 420, the consumer may place the selected ambient product 30 in the scanner module 160. At step 430, the scanner module 160 identifies the product 30 therein. If the product 30 is identified, the process continues to step 440. If not, the process is terminated. At step 440, the internal transport system 190 may dispense a temperature controlled product 40 to the vending port 180 that is temperature controlled and corresponds to the selected ambient product 30. At step 450, the internal transport system 190 may position the ambient product 30 into the appropriate column 210 in the temperature controlled compartment 130 so as to be temperature controlled and for later use as the temperature controlled product 40. The method ends at step 460. Other method steps may be used herein.

The merchandiser 100 may provide for at least a degree of product "purity", i.e., only a single brand, series of brands, or brands of a specific company may be recognized by the scanner module 160 such that any other products 10 or brands may be rejected. This may be accomplished, for example, by the scanner module 160 being adapted to recognize only predetermined products, rejecting all others by default. Further, a percentage of the products 10 therein may be of one brand or one company and a certain percentage may be of another. To enforce a permitted "purity" percentage, the scanner module 160 further may include a counter-mechanism to keep inventory of different products 10 on hand in the temperature controlled compartment 130 and reject certain products 10 if their proportion in the temperature controlled compartment 130 exceeds a predetermined limit. Any percentage may be used herein. A balance of products 10 likewise may or may not be found in the ambient compartment 110 and the temperature controlled compartment 130.

The use of the merchandiser 100 thus provides the impulse purchases often found with an open front cooler given the use of the ambient compartment 110. The merchandiser 100, however, also provides the energy efficiency (and potentially even great efficiency) typically found with a glass door merchandiser given the use of the relatively smaller temperature controlled compartment 130 and the general lack of temperature controls about the ambient compartment 110.

Moreover, the positioning of the scanner module 160 directly on top of the vending port 180 may give the consumer an enjoyable "instant chill" experience, i.e., simulating that the ambient product 30 was instantaneously cooled to its desired temperature as the temperature controlled product 140. The merchandiser 100 thus provides impulse purchases, energy efficiency, and an improved and enjoyable consumer experience.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A merchandiser, comprising:

an ambient compartment with a plurality of different types of ambient products therein;

a temperature controlled compartment with a plurality of different types of temperature controlled products therein; and a first of the plurality of different types of ambient products corresponding to a first of the plurality of different types of temperature controlled products;

a vending module in communication with the temperature controlled compartment;

an identification module to identify the plurality of different types of ambient products for dispensing a corresponding temperature controlled product;

the identification module in communication with the plurality of different types of temperature controlled products in the temperature controlled compartment;

the vending module adapted to dispense the first temperature controlled product in response to the first ambient product being placed in communication with the identification module and identified therein.

2. The merchandiser of claim 1, wherein the ambient compartment comprises a plurality of ambient compartment shelves.

3. The merchandiser of claim 1, wherein the temperature controlled compartment comprises one or more temperature controlled shelves.

4. The merchandiser of claim 1, wherein the ambient compartment comprises a vending compartment.

5. The merchandiser of claim 1, wherein the vending module comprises an internal transport system in communication with the identification module and a vending chute.

6. The merchandiser of claim 1, wherein the temperature controlled compartment comprises one or more temperature controlled shelves with a plurality of columns thereon and wherein the vending module comprises a plurality of column conveyor belts positioned about the plurality of columns.

7. The merchandiser of claim 6, wherein the vending module comprises one or more transverse conveyor belts in communication with the plurality of column conveyor belts.

8. The merchandiser of claim 1, wherein the temperature controlled compartment comprises a plurality of vertical chutes and wherein the vending module comprises a top conveyor belt positioned about the plurality of vertical chutes.

9. The merchandiser of claim 1, wherein the temperature controlled compartment comprises a heating/cooling module.

10. The merchandiser of claim 1, wherein the ambient compartment is separate from the temperature controlled compartment.

11. The merchandiser of claim 1, wherein the ambient compartment comprises an open compartment.

12. The merchandiser of claim 1, wherein the ambient compartment comprises a closed compartment with a door including a transparent portion permitting viewing at least one of the plurality of different types of ambient products inside the compartment.

13. The merchandiser of claim 12, further comprising a payment module and wherein the door is accessible only upon a user completing a payment operation using the payment module.

14. A method of dispensing a number of temperature controlled products, comprising:

providing a plurality of different types of ambient products in an ambient compartment and a plurality of different types of temperature controlled products in a temperature controlled compartment;

identifying a selected first one of the plurality of different types of ambient products via an identification module in communication with the plurality of different types of temperature controlled products in the temperature controlled compartment;

maneuvering the selected first one of the plurality of different types of ambient products to the temperature controlled compartment; and dispensing one of the plurality of different types of temperature controlled products wherein the one of the plurality of different types of temperature controlled products corresponds to the identified selected first one of the plurality of different types of ambient products.

15. The method of dispensing a number of temperature controlled products of claim 14, wherein the step of providing a plurality of different types of ambient products comprises positioning a plurality of different types of ambient products in an open compartment.

16. The method of dispensing a number of temperature controlled products of claim 14, wherein the step of providing a plurality of different types of ambient products comprises providing a plurality of different types of ambient products in a vending compartment.

17. The method of dispensing a number of temperature controlled products of claim 14, wherein the one of the plurality of different types of temperature controlled products comprises a cooled product.

18. The method of dispensing a number of temperature controlled products of claim 14, wherein the one of the plurality of different types of temperature controlled products comprises a heated product.

19. A merchandiser, comprising:

an open compartment with a plurality of different types of ambient products positioned on a plurality of ambient product shelves;

a temperature controlled compartment with a plurality of different types of temperature controlled products positioned on one or more temperature controlled shelves;

an identification module;

the identification module in communication with the plurality of different types of temperature controlled products in the temperature controlled compartment; and a vending module in communication with the temperature controlled compartment;

wherein the identification module identifies a first one of the plurality of different types of ambient products for vending and the vending module vends one of the plurality of different types of temperature controlled products that corresponds to the identified first one of the plurality of different types of ambient products as determined by the identification module.

20. The merchandiser of claim 19, wherein the vending module comprises an internal transport system in communication with the identification module and a vending chute.

21. The merchandiser of claim 19, wherein the temperature controlled compartment comprises a heating/cooling module.

22. The merchandiser of claim 19, wherein the open compartment is separate from the temperature controlled compartment.

* * * * *